US007854688B2

(12) United States Patent
Zheng

(10) Patent No.: US 7,854,688 B2
(45) Date of Patent: Dec. 21, 2010

(54) COLLAPSIBLE PLAY STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 1332 days.

(21) Appl. No.: 10/695,705

(22) Filed: Oct. 29, 2003

(65) Prior Publication Data

US 2005/0096185 A1 May 5, 2005

(51) Int. Cl.
*A63B 21/00* (2006.01)

(52) U.S. Cl. ..... 482/35; 190/107; 220/9.2

(58) Field of Classification Search ..... 190/107; 224/634, 576, 645, 656; 220/9, 2; 273/317; 482/35, 135; 383/40, 41, 66, 28, 14
See application file for complete search history.

(56) References Cited

U.S. PATENT DOCUMENTS

| | | | | | |
|---|---|---|---|---|---|
| 2,959,413 | A | | 11/1960 | Rosenzweig | |
| 3,244,420 | A | * | 4/1966 | Poynter | 273/402 |
| 3,895,796 | A | | 7/1975 | Pestalozzi | |
| 3,928,701 | A | | 12/1975 | Roehner | |
| 3,960,161 | A | | 6/1976 | Norman | |
| 4,629,182 | A | | 12/1986 | Rader et al. | |
| 5,031,652 | A | | 7/1991 | Lester | |
| 5,064,195 | A | * | 11/1991 | McMahan et al. | 473/480 |
| 5,095,942 | A | | 3/1992 | Murphy | |
| 5,159,948 | A | | 11/1992 | Moreau et al. | |
| D346,111 | S | * | 4/1994 | Hale | D3/271.3 |
| 5,343,887 | A | | 9/1994 | Danaher | |
| 5,618,246 | A | | 4/1997 | Zheng | |
| D379,209 | S | * | 5/1997 | Coddington, Jr. | D21/419 |
| 5,762,569 | A | * | 6/1998 | Hale | 473/480 |
| 5,779,570 | A | * | 7/1998 | Bear | 473/481 |
| 6,402,153 | B1 | * | 6/2002 | Stewart | 273/317 |
| 6,431,393 | B1 | | 8/2002 | Stewart | |
| 6,520,365 | B2 | * | 2/2003 | Schneider | 220/9.2 |
| 6,830,170 | B2 | * | 12/2004 | Abel | 224/634 |
| 7,066,647 | B2 | * | 6/2006 | Peska | 383/40 |
| 2002/0030052 | A1 | * | 3/2002 | Joo-Tai | 220/9.2 |
| 2003/0022761 | A1 | * | 1/2003 | Brereton | 482/35 |

* cited by examiner

*Primary Examiner*—Jerome Donnelly
(74) *Attorney, Agent, or Firm*—Raymond Sun

(57) ABSTRACT

A collapsible play structure has a coiled wire supporting a covering which is attached to the wire to define an interior tunnel-like passageway, and at least one opening provided in the covering. A basketball goal assembly can be attached to a first end of the coiled wire and covering. In addition, openings can be provided in the covering.

3 Claims, 3 Drawing Sheets

COLLAPSIBLE PLAY STRUCTURES

BACKGROUND OF THE INVENTION

1. Field of the Invention

The present invention relates to play structures for children, and in particular to collapsible play structures. The play structures can be collapsed and folded into a compact configuration for easy transportation and storage.

2. Description of the Prior Art

Two important considerations for all toys or play things targeted for children are convenience and variety. Relating to convenience, a toy must be easily transportable so that the child can move it around the home, or even to other places outside of the home. A toy must also be easily stored since a child is likely to have many other toys that compete for precious storage space in the home. As for variety, a toy must offer enough variety in play so that the child will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space.

In the past, attempts have been made to provide play structures for the entertainment of children. Such play structures have been provided in many different shapes and sizes. For example, some have been shaped as playhouses to allow children to climb into and out of the structure. However, in order to provide a structure that can temporarily house a child, such a structure must be quite large and would be difficult to transport and store.

Another type of play structure that has been popular with children is a play tunnel. These play tunnels provide a long passageway or tunnel through which a child can crawl. These play tunnels are normally made by wrapping a piece of fabric about a helically-shaped metal loop, with the loop defining the shape of the tunnel. Since the metal loop is helical, the tunnel may be collapsed into a smaller configuration by pressing both ends of the tunnel against each other, and then tying both ends together. For example, U.S. Pat. No. 5,618,246 to Zheng illustrates examples of such play tunnels.

Thus, there remains a need for a play structure which provides for increased variety of play, and is convenient to use, to transport, and to store.

SUMMARY OF THE DISCLOSURE

In order to accomplish the objects of the present invention, the collapsible play structure according to the present invention has a coiled wire supporting a covering which is attached to the wire to define an interior tunnel-like passageway, and at least one opening provided in the covering. A basketball goal assembly can be attached to a first end of the coiled wire and covering. In addition, openings can be provided in the covering.

In one embodiment of the present invention, a first tie member is provided at the first end, a second tie member is provided at a second end of the coiled wire and covering, and a third tie member is provided on the covering at a location between the first end and the second end. The third tie member can be releasably coupled to either the first or second tie member to vary the length of the tunnel-like passageway.

In another embodiment of the present invention, a wall is provided at the first end to close the opening defined by the first edge, with a top opening provided in the wall, and a helical track is provided about the covering and communicates with the top opening.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
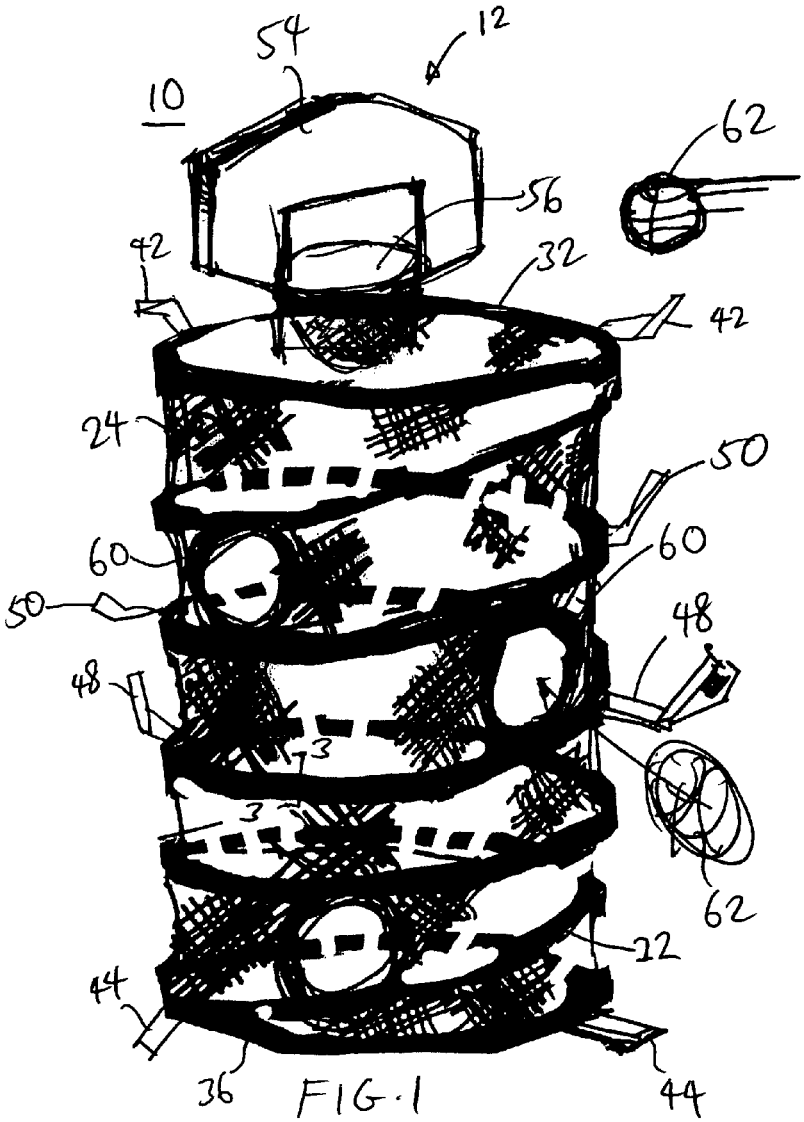
FIG. 1 is a perspective view of a collapsible play structure according to one embodiment of the present invention.
Figure 3:
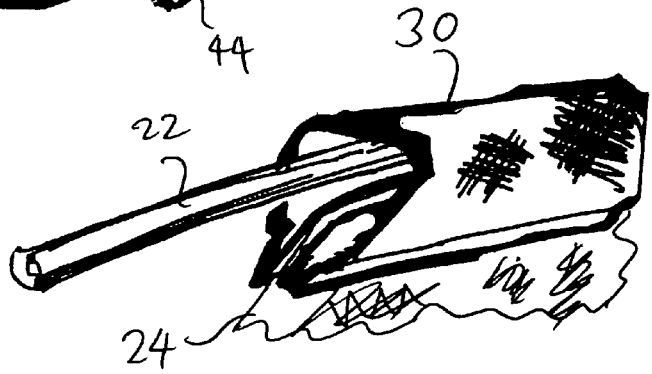
FIG. 3 is a cross-sectional view of the tunnel of FIG. 1 taken along line 3-3 thereof.
Figure 2:
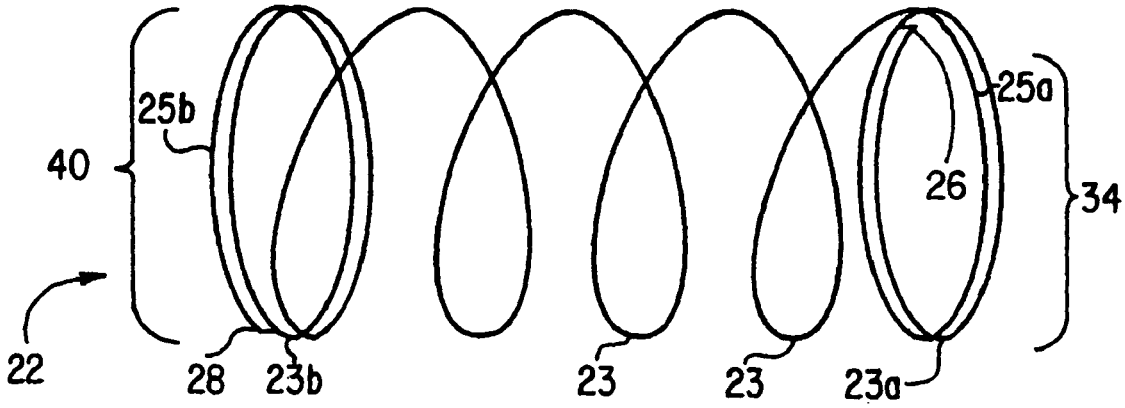
FIG. 2 is a perspective view of an internal wire that is used to define and support the tunnel of FIG. 1.

As shown in FIGS. 1-3, a collapsible play structure 10 according to one embodiment of the present invention has a basketball goal assembly 12 attached to one end of a collapsible tunnel 14. The tunnel 14 has an internal support wire 22 supporting a covering 24 which is attached to the wire 22 to define the tunnel-like passageway. The wire 22 is helically coiled, with the adjacent coils 23 being normally biased in spaced apart relation, as shown in FIG. 2. The wire 22 defines a first end 26 and a second end 28. At the first and second ends 26 and 28, the wire 22 extends past the outer coil 23*a* and 23*b*, respectively, so that a segment 25*a* and 25*b* at each end 26, 28 of the wire 22 overlaps with the outer coil 23*a* and 23*b*, respectively.

The covering 24 is attached to the wire 22 by gluing, stitching, fusing, mechanically fastening or other conventional attachment methods. Alternatively, as shown in FIG. 3, a sleeve 30 may be stitched or otherwise provided along the covering 24 with the wire 22 housed or attached therein. The first end 26 of the wire 22 terminates at a first substantially circular edge 32 of the covering 24. The outer coil 23*a* of the first end 26 forms a substantially circular end wire portion 34 to provide support to the first edge 32 of the covering 24. Similarly, the second end 28 of the wire 22 terminates at a second substantially circular edge 36 of the covering 24. The outer coil 23*b* of the second end 28 forms another substantially circular end wire portion 40 to provide support to the second edge 36. The circular end wire portions 34 and 40 and their respective circular edges 32 and 36 each defines an opening. As an alternative, the opening defined by the wire portion 40 and the edge 36 can be covered by a fabric wall (not shown).

The overlapping segment 25*a* may be attached to the outer coil 23*a* along the length of the segment 25*a*, or the outer coil 23*a* and the overlapping segment 25*a* at the first end 26 of the wire 22 may be retained in the same sleeve 30. Similarly, the overlapping segment 25*b* may be attached to the outer coil 23*b* along the length of the segment 25*b*, or the outer coil 23*b* and the overlapping segment 25*b* at the second end 28 of the wire 22 may be retained in the same sleeve 30.

A first set of tie members 42 are provided in spaced-apart manner along the first edge 32, and a second set of tie members 44 are provided in spaced-apart manner along the second edge 36. Each tie member 42, 44 can be embodied as two strings or thin pieces of fabric which can be tied together to create a knot, or as opposing straps that carry a VELCRO™ pad. Each set of tie members 42, 44 could comprise any number of tie members (including just one tie member), but preferably comprises at least two tie members.

Figure 4:
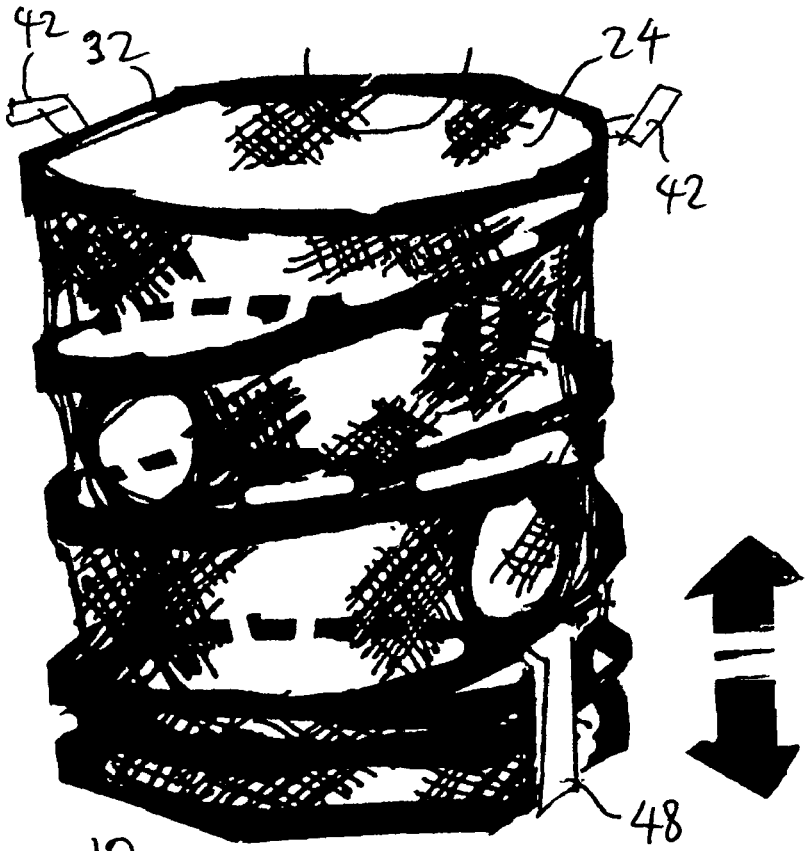
FIG. 4 is a perspective view of the structure of FIG. 1 showing part of the structure being compressed.

Optionally, additional sets of tie members 48, 50 can be provided at the location of any coil 23 between the edges 32 and 36. These tie members 48, 50 can be used to engaged one of the other sets of tie members 42 or 44 to reduce or vary the length of the tunnel 14. For example, the set of tie members 48 shown in FIG. 1 can be engaged with either one of the other sets of tie members 42 or 44 to reduce the length of the tunnel 14 by half, as shown in FIG. 4 (without the basketball goal assembly 12), or with other tie members (e.g., 50) to vary the length of the tunnel 14.

The wire 22 is preferably made from a strong yet springy metal, such as steel or iron, but also can be made from other strong and coilable materials, such as fiberglass or plastic. Such materials are preferably capable of allowing the wire 22 to maintain its coiled shape. The covering 24 is preferably made from a strong durable fabric, such as cotton, canvas, mesh or net, but can also be made from other strong durable materials such as PVC or plastic. The term fabric is to be given its broadest meaning and should be made from strong, lightweight materials and may include woven fabrics, sheet fabrics or even films. The covering 24 can be water-resistant and should be durable to withstand the wear and tear associated with rough treatment by children.

The basketball goal assembly 12 can include a backboard 54 and a basketball net or goal 56 secured to one side of the backboard 54. The base of the backboard 54 can be removably secured to the edge 32 of the tunnel 14 by a clamp, or any other device that allows the backboard 54 to be secured in an upright orientation with respect to the tunnel 14 and the opening defined by the edge 32.

One or more openings 60 can be provided on the covering 24. Thus, the user can attempt to toss a ball 62 through either one of the openings 60, or into the goal 56.

The collapsible play structure 10 can be easily collapsed and folded for storage by compressing the tunnel 14. Specifically, to compress a tunnel 14, the user grips the circular end wire portion 34, or the first edge 32, of the tunnel 14 with one hand, and while using the other hand to grip the other circular end wire portion 40, or the second edge 36, pushes or compresses the end wire portion 34 against the end wire portion 40. This compresses the plurality of helical coils of the wire 22 against each other. This compression is made possible by the springy nature of the wire 22, and its helically coiled configuration. With the wire 22 compressed, the tie members of the first and second sets of tie members 42, 44 are tied together to secure the tunnel 14 in a compressed configuration.

Figure 5:
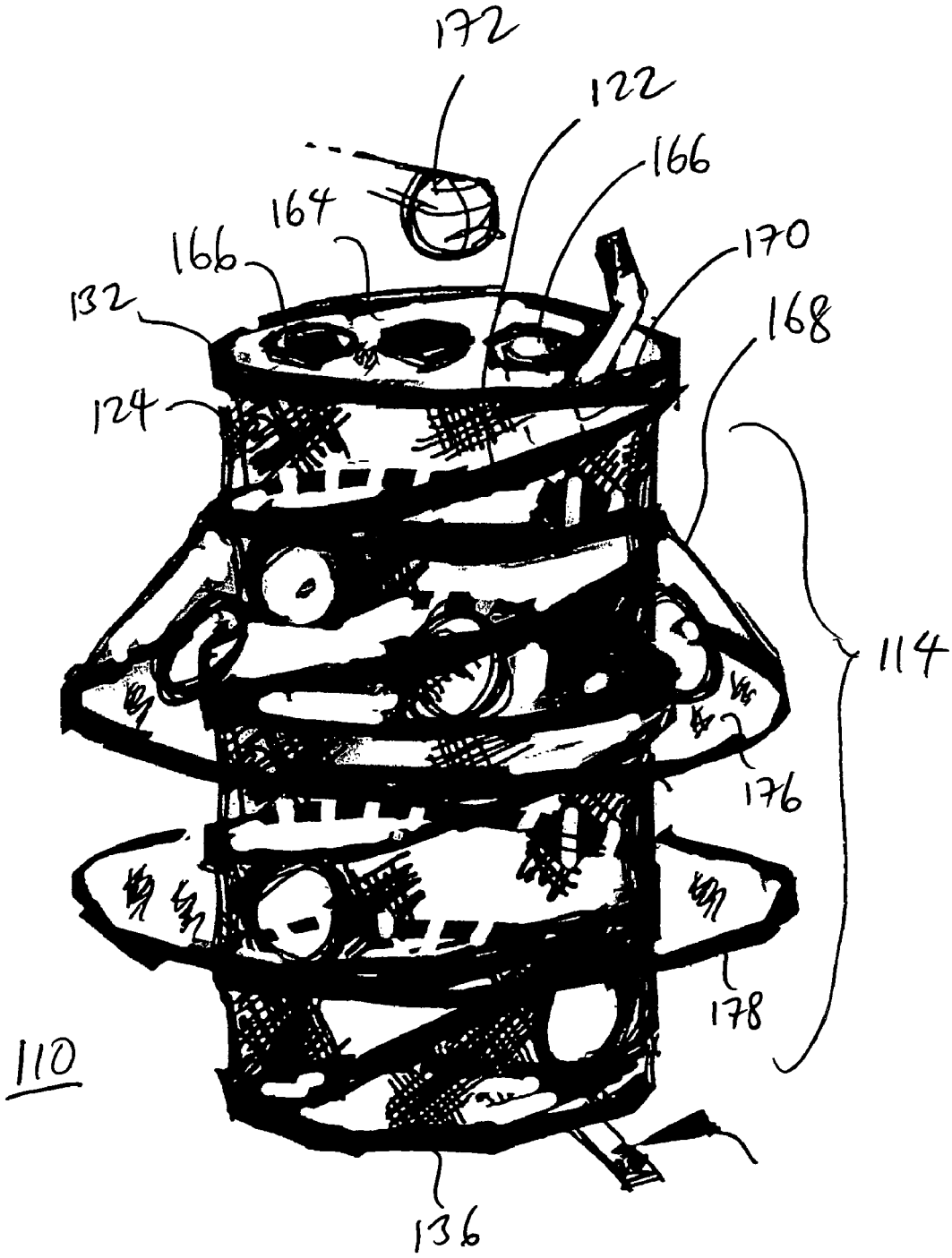
FIG. 5 is a perspective view of a collapsible play structure according to another embodiment of the present invention.

FIG. 5 illustrates another embodiment of a collapsible play structure 110 according to the present invention. The structure 110 is essentially the same as the structure 10 in that it has a tunnel 114 that has an internal support wire 122 supporting a covering 124 which is attached to the wire 122 to define the tunnel-like passageway. The construction of the wire 122 and the covering 124 can be identical to the wire 22 and the covering 24 described above. The only difference between the structures 10 and 110 is that a wall 164 is provided to cover the opening defined by the first edge 132, and one or more openings 166 are provided in the wall 164. The wall 164 can be made of fabric. In addition, a helical track 168 is provided along the outer surface of the covering 124. A fabric tube 170 that is connected to one of the openings 166 can be coupled to the helical track 168 so that a ball 172 that enters the opening 166 can travel down the fabric tube 170, through an opening in the covering 124, and travel along the helical track 168 towards the bottom (i.e., the second edge 136) of the tunnel 114. The helical track 168 can be formed by providing a piece of fabric 176 that is bordered by a flexible wire 178 that can be the same as the wire 22.

As an alternative, the helical track 168 can also be provided along the inner surface of the covering 124.

It will be appreciated by those skilled in the art that the shapes and configurations of the structures 10 and 110 can be modified without departing from the spirit and scope of the present invention. For example, the tunnels 14 and 114 need not necessarily be substantially straight, as shown in FIGS. 1, 4 and 5, but can assume other configurations such as an L-shaped, S-shaped, U-shaped, or other configurations. This can be accomplished by providing the internal support wire 22 in the desired configuration and then attaching the covering 24 to it to form the tunnel. Further, the length of the tunnels 14, 114 can be varied to form tunnels of different lengths. As a further example, the tunnels 14, 114 do not necessarily need to be substantially circular, but can assume a square, rectangular, triangular, polygonal or other shape. This can accomplished by coiling the internal support wire 22 to the desired shape and then attaching the covering 24 to it to form the tunnel. Moreover, any combination of modifications described hereinabove may be utilized to provide the tunnels 14, 114 of varying shapes and sizes without departing from the spirit and scope of the present invention.

In addition, the tunnels 14, 114 can be placed on their sides and used as actual tunnels through which children can crawl. Thus, the structures 10 and 110 can be used as ball-toss targets and as actual tunnels, thereby illustrating the versatility and play variety afforded by these structures 10 and 110.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure comprising:

a coiled wire supporting a covering which is attached to the wire to define a cylindrical passageway, the coiled wire and the covering having a first end and a second end;

a wall provided at the first end, with a top opening provided in the wall;

a helical track provided about the exterior of the covering and a tube connecting the helical track with the top opening.

2. The structure of claim 1, wherein the helical track comprises a piece of fabric that is bordered by a flexible wire.

3. The structure of claim 1, wherein the helical track extends from the first end to the second end.

* * * * *